United States Patent [19]

Plough et al.

[11] 4,427,044

[45] Jan. 24, 1984

[54] LOG CENTERING DEVICE

[75] Inventors: Irving L. Plough, Snohomish; David B. Puryear, Enumclaw, both of Wash.; Charles R. Turner, Albany, Oreg.

[73] Assignee: Pigott Enterprises, Bellevue, Wash.

[21] Appl. No.: 279,066

[22] Filed: Jun. 30, 1981

[51] Int. Cl.[3] ..... B27B 1/00; B27L 5/02

[52] U.S. Cl. ..... 144/356; 144/209 A; 144/365; 356/386; 356/387; 414/331

[58] Field of Search ..... 144/209 R, 209 A, 356, 144/357, 365; 414/331, 745; 356/375, 376, 386, 387, 150

[56] References Cited

U.S. PATENT DOCUMENTS

| | | | |
|---|---|---|---|
| 1,281,569 | 10/1918 | Hillerich . | |
| 1,646,115 | 10/1927 | Sjostrom | 144/209 R |
| 2,441,925 | 5/1948 | Wege | 144/209 A |
| 2,523,563 | 9/1950 | Foreman | 144/209 A |
| 2,670,772 | 3/1954 | Hervey | 144/209 A X |
| 3,036,607 | 5/1962 | Raura | 144/209 A |
| 3,037,538 | 6/1962 | Graham | 144/209 A |
| 3,088,505 | 5/1963 | Pearson | 144/209 A |
| 3,504,719 | 4/1970 | Don | 144/20 A |
| 3,604,940 | 9/1971 | Matthews | 356/386 |
| 3,615,139 | 10/1971 | Bostrom . | |
| 3,643,715 | 2/1972 | Hayes et al. | 144/209 A |
| 3,664,395 | 5/1972 | Reed | 144/209 A |
| 3,698,818 | 10/1972 | Bowker et al. | 356/387 |
| 3,712,741 | 1/1973 | Revert | 356/150 |
| 3,736,968 | 6/1973 | Mason | 144/3 R |
| 3,746,065 | 7/1973 | Mason | 144/309 A |
| 3,749,499 | 7/1973 | Reichard et al. | 356/150 |
| 3,760,855 | 9/1973 | Nilberg | 144/209 A |
| 3,852,575 | 12/1974 | Sohn et al. | 144/209 A X |
| 3,891,016 | 6/1975 | Nilberg | 144/209 A |
| 3,895,662 | 7/1975 | Noriyuki et al. | 144/204 A |
| 3,902,539 | 9/1975 | Ketteler | 144/209 A |
| 3,945,125 | 3/1976 | Mouat et al. | 33/174 R |
| 3,987,825 | 10/1976 | Vignolles | 144/208 F |
| 4,197,888 | 4/1980 | McGee et al. | 144/209 A |

*Primary Examiner*—W. D. Bray

*Attorney, Agent, or Firm*—Dowrey & Cross

[57] ABSTRACT

The present invention is directed to an apparatus and method for determining the center axis of the largest solid of rotation obtainable from an irregular, elongated object such as a log or veneer block. The object is rotatably supported by two pairs of opposed wheeled supports positioned inward of the ends of the object. A motor-driven press roller maintains the object in contact with the wheeled supports and causes it to rotate thereon. The motion of the ends of the object as it rotates is used to define a locus of points at each end of the log. The centers of the largest circles which fit within these loci define the desired center axis.

35 Claims, 12 Drawing Figures

FIG. 3
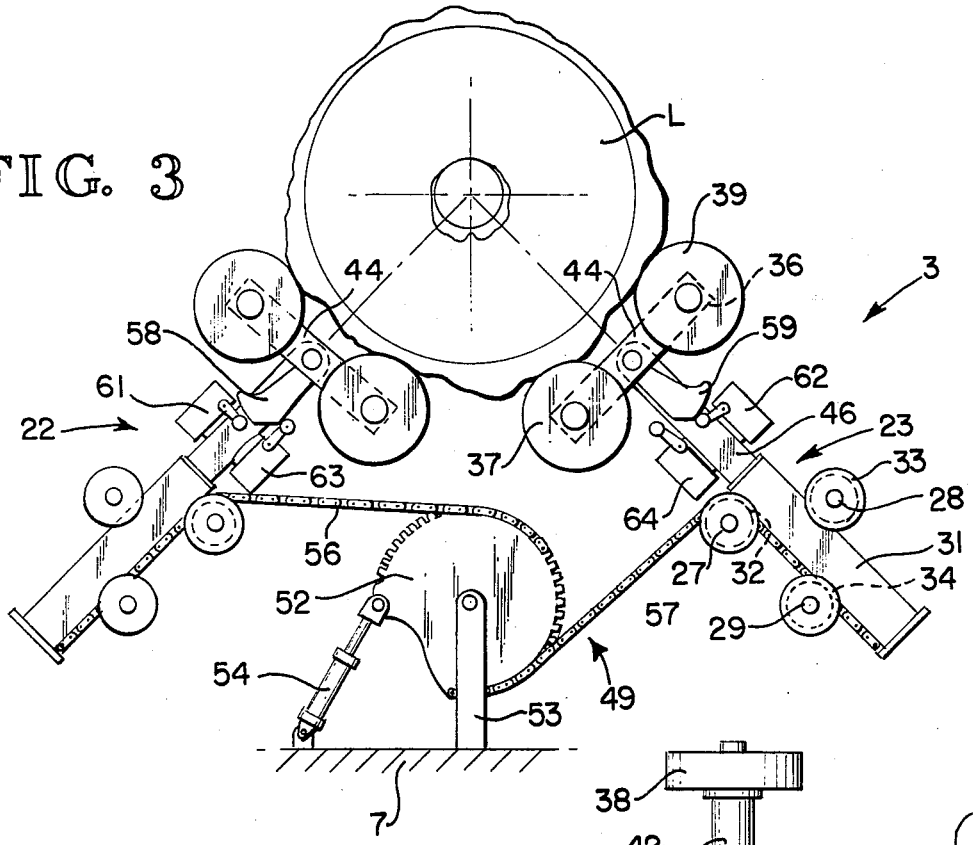
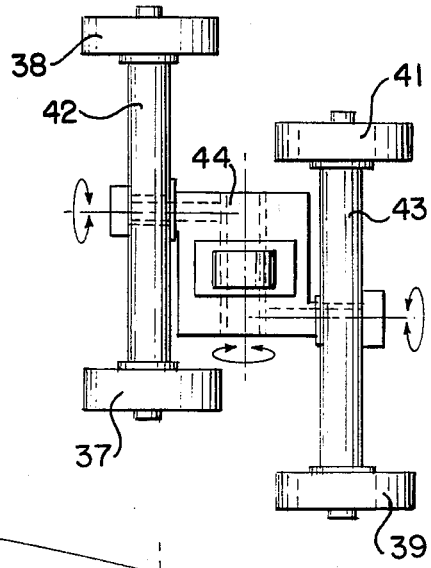
FIG. 4
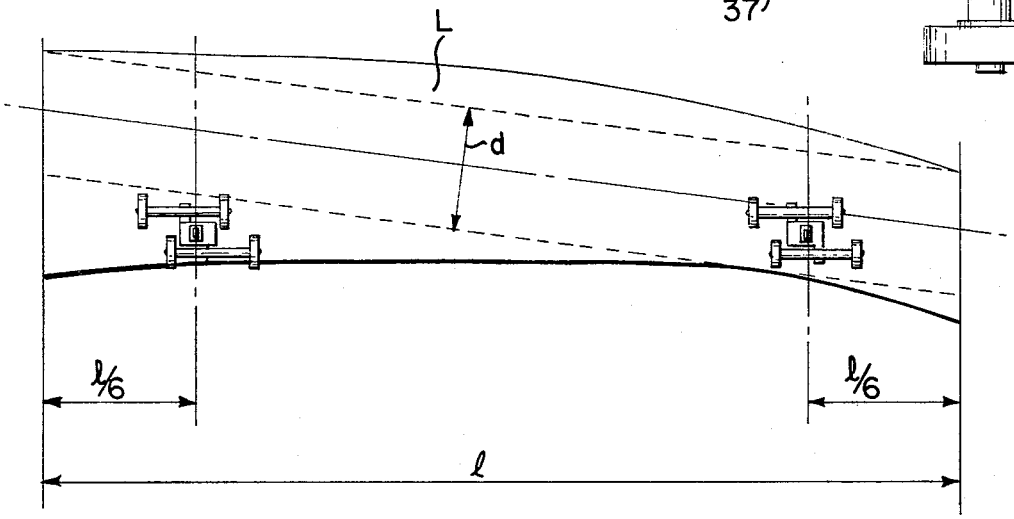
FIG. 5

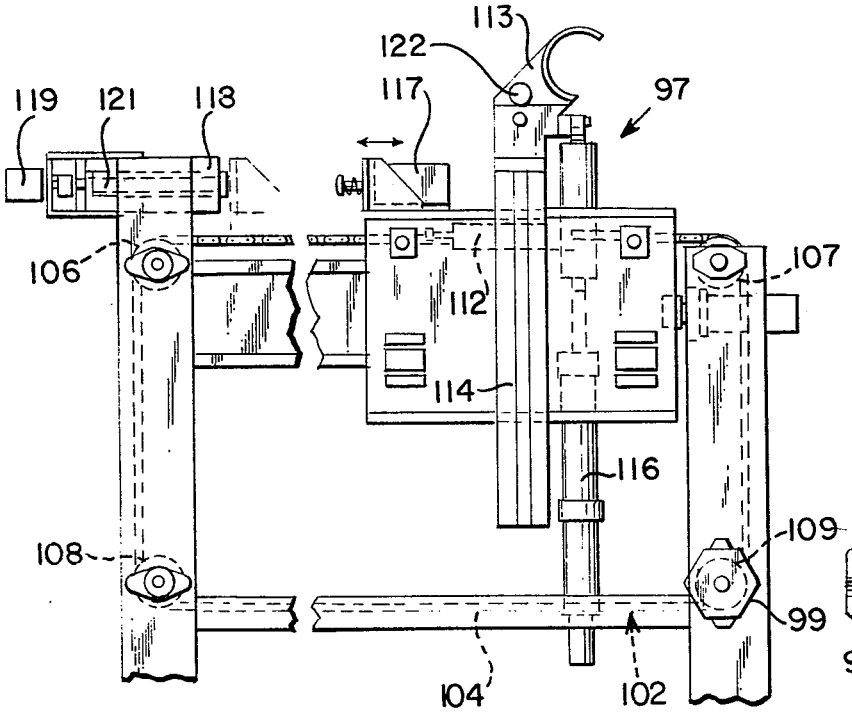
FIG. 8
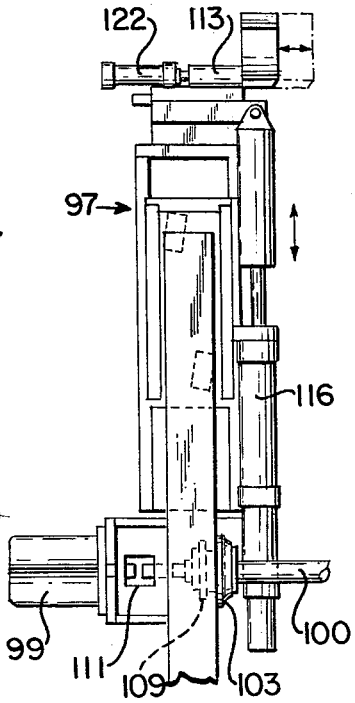
FIG. 9
FIG. 10
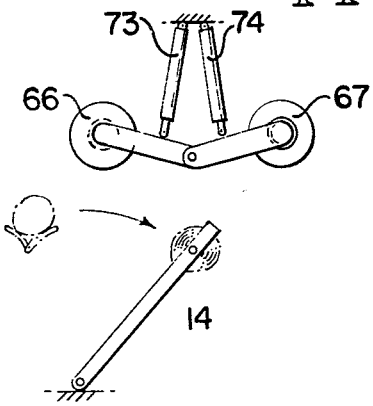
FIG. 11
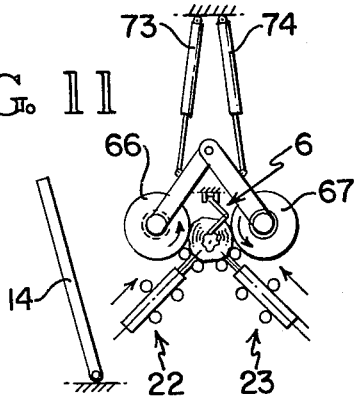
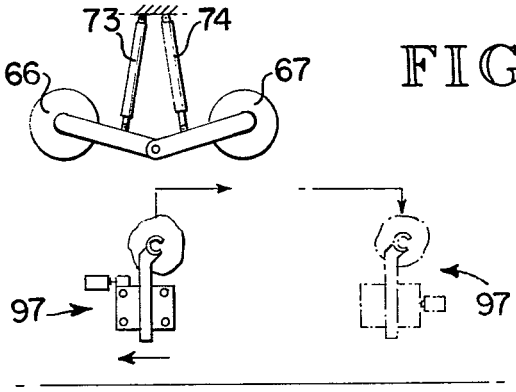
FIG. 12

LOG CENTERING DEVICE

BACKGROUND OF THE INVENTION

1. Field of the Invention

This invention relates to apparatus and method for locating the center axis of the largest solid of rotation contained within an irregular elongated object. Although the method and apparatus may be used with any such elongated object, they may be employed to particular advantage in the wood products industry for aligning veneer blocks for peeling on a lathe into veneer. Accordingly, for the sake of clarity and to facilitate explanation of the invention, the method and apparatus will be described herein with respect to determining the center axis of the largest solid cylinder of wood contained within a veneer block. The veneer block can then be chucked in a veneer peeling lathe along this axis to recover the maximum amount of continuous sheet veneer that can be peeled therefrom.

In many conventional veneer plants, logs are brought to the mill and cut into segments called veneer logs or veneer blocks which are of a sufficient length to produce the desired width of veneer. Most frequently the veneer blocks are cut to lengths of either four or eight feet. These blocks are then introduced into the mill where they are treated to prepare them for peeling into veneer and are transferred by conveyors into the mill.

In some installations, the veneer blocks are loaded by the conveyors into vee blocks for approximate geometric centering. The vee blocks comprise two pairs of vees, each pair of which has an upper and lower v-shaped member which are hydraulically or mechanically interconnected to move in unison toward or away from one another. These blocks are always aligned to close on the clamping axis of the charger. The two pairs of vees close on the log until they can move no farther. The log is then clamped by the charger, transferred to the veneer lathe, and spindled in the lathe along the geometric center axis. As the veneer block is rotated in the lathe, a peeling blade is brought against the surface of the block and cuts the block into veneer.

This method of loading veneer blocks has the advantage that it is extremely rapid and thus the total volume of veneer produced in a given period is relatively high. The operator, however, is given no discretion in selection of the spin axis about which the log is rotated.

Other methods of loading veneer blocks give the operator control of the positioning of the veneer block in the lathe and thus permits him to account for irregularities and defects in the log, but these methods generally slow the veneer production process or require additional personnel. Moreover, these methods often give the operator little guidance in determining how to center logs which are not straight or which have non-circular cross-sections.

2. Description of the Prior Art

As the supply of available timber has decreased, the cost of such timber to sawmills and veneer plants has increased dramatically. Accordingly, for both environmental and economic reasons, numerous methods and devices have been invented and developed in recent years to improve the accuracy of positioning of veneer blocks and logs in the log processing apparatus in order to improve yields and eliminate waste.

For example, U.S. Pat. Nos. 3,504,719 to Don and 3,664,395 to Reed disclose two devices which perform mechanical centering of veneer blocks at two cross-sections along their length. These devices perform the centering very quickly, but do not account for curvature or bending of the log known as sweep and crook. U.S. Pat. No. 3,037,538 to Graham also discloses a centering device for veneer in which concentric rings of light are projected onto the ends of the log, and the operator shifts each end of the log until the circle of maximum diameter which will fit on each log end is determined. The centers of these circles are deemed to define the desired axis of rotation of the veneer block in the lathe. Although the operator presumably could make corrections for crook, sweep and off-center flaring, this apparatus provides no quantitative method for so doing.

U.S. Pat. Nos. 3,760,855 and 3,891,016, both to Nilberg, disclose an electro-mechanical apparatus which senses the surface of the log with a plurality of probes and determines the largest cylinder or stepped cylinder which fits within a mechanical model of the log. These devices, unfortunately, are quite complex.

U.S. Pat. Nos. 3,736,968 to Mason et al. and 3,746,065 to Mason disclose apparatus for determining the center axis of a log or veneer block. These devices employ photoelectric scanners and reorient the log or block with its center axis parallel to an index line of the processing equipment.

U.S. Pat. No. 3,857,579 to Sohn et al. discloses a device which is similar to Nilberg in that it determines the contour of the log surface at a plurality of cross-section locations along its length and locates the center axis of the largest cylinder which fits within the log cross-sections. This is accomplished by means of laser ranging devices which measure the surface of the log while the log is rotated. U.S. Pat. No. 3,945,125 to Mouat et al. similarly discloses an apparatus which measures the profile of the log while it is rotated in order to find the largest cylinder contained therein, but uses a mechanical probe in lieu of the laser ranging device of Sohn et al.

U.S. Pat. No. 3,749,499 to Reichard et al. discloses an optical masking techique used in the semiconductor industry for locating the center axis of the largest solid cylinder of semiconductor material contained within an elongated irregular rod of the material.

SUMMARY OF THE INVENTION

The present invention is directed to a method and apparatus of determining the center axis of the largest solid of rotation, such as a cylinder, which is obtainable from an irregular elongated body such as a log. As with the apparatus and methods set forth above, the present method and apparatus for determining this axis yield only approximate results since an exact solution would obviously require consideration of the entire surface of the log. Nevertheless, the approximate axis determined according to the present invention is very accurate.

In one embodiment of the present invention, the center axis of the largest cylinder is determined by supporting the veneer block on two pairs of opposed supports, each support pair being located approximately one-sixth of the length of the log from the adjacent end. Two motor-driven press rollers engage the upper surface of the veneer block and cause the block to rotate about its longitudinal axis while maintaining contact between the log and the supports. The movement of the end of the log relative to the fixed portions of the apparatus, such as the supports, is monitored and used to define a locus of points.

In one embodiment, this locus of points is defined by fixing a marking device to the apparatus at a point below the expected axis of rotation of the log on the supports. As the veneer block is rotated, the marking device is activated and marks a trace in the form of a closed curve on the end of the log. The centers of the largest circles which fit within the traces may then be used as the chucking points for engagement of the veneer lathe spindles. These circles may be determined by projecting concentric light rings in the trace and adjusting the position of the ends of the block in a manner similar to that described in the aforementioned U.S. Pat. No. 3,037,538 to Graham. Movement of the ends of the veneer block can also be tracked electronically by means of absolute position encoders mounted on tracking arms as described below.

It is thus one object of the invention to provide a method and apparatus for locating the axis of the largest solid of rotation, such as a cylinder which is contained in the irregular elongated object, for example, a veneer block.

Another object of the invention is to provide a method and apparatus which is reliable in adverse environments such as a sawmill or veneer mill.

A further object of the invention is to provide such a method and apparatus which require minimal supervision and involvement of the operator.

Other objects of the invention will be apparent by reference to the drawings and detailed description of the invention.

BRIEF DESCRIPTION OF THE DRAWINGS

FIG. 3 is a cross-sectional detail taken along line 3—3 in FIG. 4 showing one pair of the log supporting members and the associated driving mechanism.

FIG. 4 is a top plan view of the gimballed, wheeled, log-engaging members of the log-supporting apparatus showing the axes of rotation of the axle supports thereof.

FIG. 5 is a side elevation of a log showing the location of the center axis thereof and the placement of the wheeled members relative thereto.

FIG. 8 is a side elevational detail of the tracking mechanism of the log charging apparatus of FIG. 1.

FIG. 9 is an end elevation of the tracking mechanism of FIG. 8.

FIGS. 10–12 are side elevations of the apparatus of FIG. 1 with parts removed showing the sequence of operation of the apparatus.

DETAILED DESCRIPTION OF THE PREFERRED EMBODIMENT

Although the method and apparatus of the present invention may be used for determining the center axis of the largest solid of rotation, such as a cylinder which will fit within an irregular, elongated object, the invention may advantageously be used for determining the axis of the largest cylinder which is contained within a veneer block.

Figure 1:
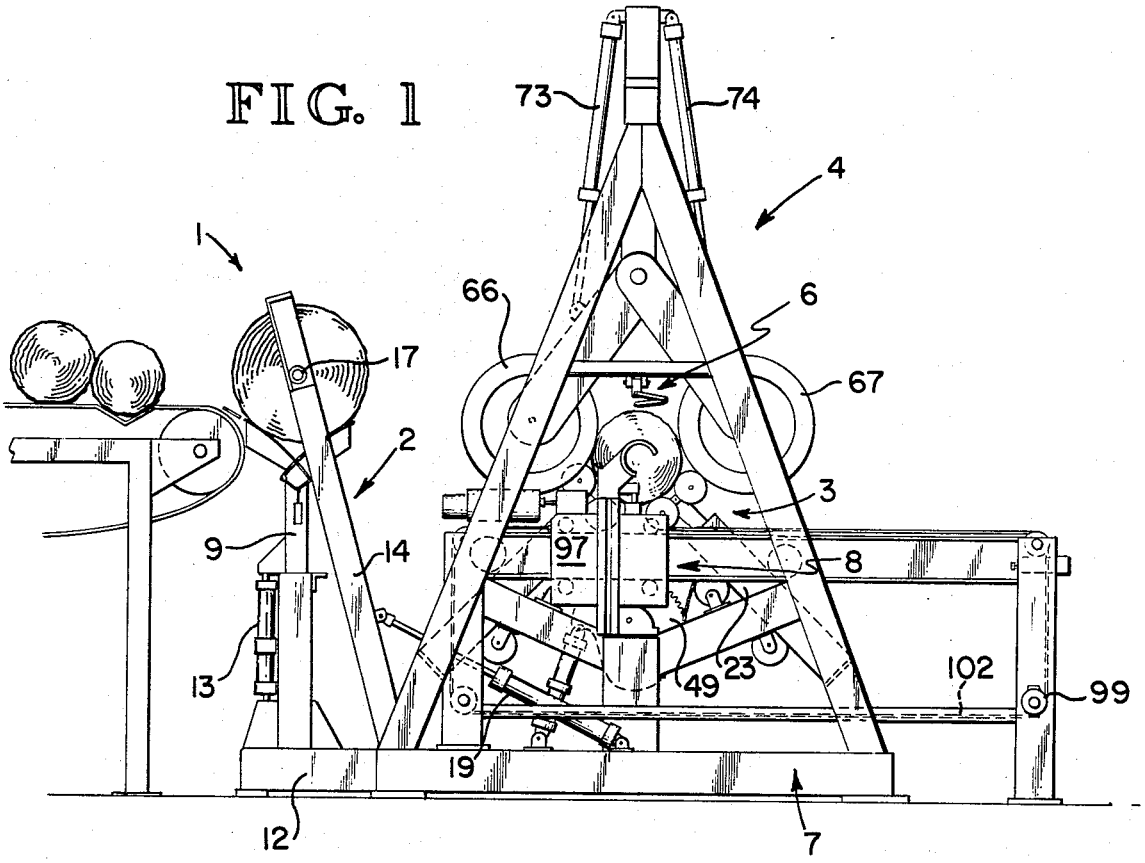
FIG. 1 is a side elevation of an apparatus for determining the center axis of a log, according to the present invention.

The apparatus of FIG. 1 includes yoke system 1, an infeed charger 2 and a log support mechanism 3 for receiving the log from the infeed charger 2. A retractable drive roller assembly 4 is positioned above the log support mechanism 2 for engaging the upper surface of a veneer block. The apparatus further includes a tracking arm assembly 6 mounted to the frame 7 of the apparatus adjacent the anticipated position of the ends of the veneer block log, and a carriage type lathe charger 8 movable between a first position adjacent the log support mechanism and a second position in which the veneer block is charged in a veneer lathe or round-up lathe (not shown). The frame 7, support mechanism 3 and drive roller assembly 4 form a veneer block rotational support mechanism which supports the block and rotates it relative thereto.

Figure 2:
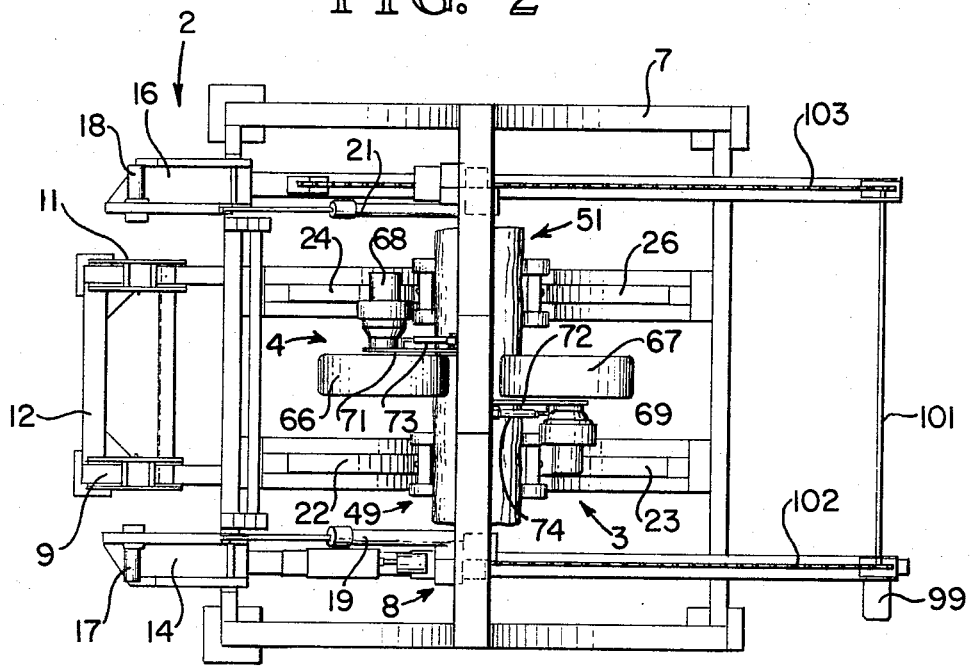
FIG. 2 is a top plan view of the apparatus of FIG. 1.

The infeed yoke system 1 initially receives veneer blocks being introduced into the system. As shown in FIGS. 1 and 2, the infeed yoke system comprises a pair of vertically extensible Y-shaped yokes 9, 11 each of which is telescopically mounted to the frame 12 of the yoke system 1. Each yoke can be raised and lowered by means of hydraulic cylinders 13 (only one shown) connected between the frame 12 and the respectively associated yoke 9, 11. A veneer block is loaded into the yoke system center roughly in the horizontal plane as it settles into the yokes 9, 11. It can then be manipulated vertically by raising or lowering one or both of the yokes so that the infeed charger 2 can grip the veneer block approximately in the center of each end face thereof.

The infeed charger 2 is an inverted pendulum type charger and is used to transfer logs from the infeed yoke assembly 1 to the log support mechanism 3. The infeed charger 2 comprises a pair of pendulum arms 14, 16 which are pivotably connected at their lower ends to the frame 7 of the centering apparatus. The charger arms are provided with hydraulically extensible clamping dogs 17, 18 for gripping and releasing the ends of veneer blocks. Hydraulic cylinders 19, 21 connected between the frame 7 and the infeed charger arms 14, 16 are provided for moving the infeed charger from a first position adjacent the infeed yoke system 1 to a second position adjacent the log support mechanism 3.

The veneer block support mechanism 3, best illustrated in FIG. 3, includes two pairs of opposed wheeled supports 22, 23; 24, 26. As all four supports are identically configured and mounted, only one such support is described. Each support is slidably mounted to the frame 7 by means of flanged split rollers 27, 28, 29, two of which 27, 29 are positioned beneath the square shaft 31 of the support, and the other of which 28 is positioned above the shaft 31. These rollers restrain the shaft 31 against deflection in a vertical plane while allowing the shaft to move freely along its longitudinal axis. The flanges 32, 33, 34 on the rollers 27, 28, 29 restrain the shaft 31 against lateral motion. The longitudinal axes of shafts 31 of each pair of supports 22, 23; 24, 26 are aligned to intersect at a point and diverge from one another at an angle of approximately 90°.

Each support further includes a veneer block engaging wheel assembly 36, shown in FIG. 4, which includes two pairs of wheels 37, 38; 39, 41 which are offset with respect to one another such that each wheel will track along a different path as the veneer block is rotated. The pairs of wheels 37, 38; 39, 41 are joined respectively by axles 42, 43 which are pivotably mounted, in turn, to the axle mounting bracket 44. The bracket 44 is pivotably mounted to the switch support shaft 46 which is in turn connected to the square shaft 31. The wheels 37, 38; 39, 41 are thus gimbal mounted to the shaft such that local irregularities, such as a branch stub, encountered by one wheel only of the pair, will not cause as great a displacement as more generalized irregularities such as a large recess. The displacement of the log due to a local irregularity affecting a single wheel only will, in fact, be reduced by a factor of four.

Each pair of supports 22, 23; 24, 26 is connected to a support extension mechanism 49, 51 which raises the two supports 22, 23; 24, 26 of the respectively associated pair in unison. The extension mechanisms 49, 51 include a sprocket 52 which is rotatably mounted to the frame 7 by a mounting bracket 53. A hydraulic cylinder 54 is connected between the frame 7 and the periphery of the sprocket 52 such that extension and retraction of the cylinder 54 causes rotation of the sprocket 52. Two chains 56, 57 are connected respectively between the sprocket and the bases of the two associated supports 22, 23.

Both supports in each pair are equipped with cams 58, 59 connected to the axle mounting bracket 44 which respectively actuate switches 61, 62, 63, 64 mounted on the switch support shafts 46. The wheel assembly 36 and cam 59 of each support are so weighted that, when no block is being supported, the wheel assembly will pivot on the switch support shaft 46 to a more nearly vertical position until a veneer block is loaded into the support. The switches 61, 62 which contact the lower surface of the cams 58, 59 are connected in series to a solenoid valve, not shown, which controls extension and retraction of the cylinder. The switches 61, 62 and cams 58, 59 are so positioned and configured that the switches 58, 59 open when the wheel assembly 36 is perpendicular to the longitudinal axis of the support shaft, and are closed when the wheel assembly is rotated toward the vertical from the perpendicular position. The remaining two switches 63, 64 of the pair of supports 22, 23 are likewise connected in series to the solenoid valve, but these switches are closed when the wheel assembly is rotated toward the horizontal from the perpendicular position.

The closing of the first pair of switches 61, 62 enables the solenoid valve to extend the hydraulic cylinder 54. Conversely, the closing of the second switch pair 63, 64 enables the solenoid valve to retract the hydraulic cylinder. The solenoid valve is energizable by the operator or sequence controller.

Thus when a veneer block is loaded into the support assembly 3 and the solenoid valve is energized by the operator, the end of the block will be raised or lowered until at least one switch from each switch pair is opened, disenabling the solenoid valve. The second pair of log supports 24, 26 is configured identically with and functions identically to the first pair to raise or lower the other end of the veneer block.

Alternately, the supports may be adjusted to one of a fixed number of positions as by a series of stepped hydraulic cylinders, or each end of the log may be raised or lowered by the operator.

Regardless of the method used to adjust their support position, the pairs of log supports 22, 23; 24, 26 are spaced apart from one another a sufficient distance that they support the veneer block at points spaced inwardly of the end of the block by an amount between 13% and 21% of the length of the block from the adjacent end thereof. Preferably, however, the pairs of supports 22, 23; 24, 26 will be spaced inward of the ends of the block by a distance approximately equal to one-sixth of the length thereof.

This provides adequate stability for the block as it is rotated, has been found to produce the desired motion of the ends of the log relative to the frame, and results in support of the log such that the axis of the largest cylinder contained within the log is generally sufficiently near a line drawn through the points of intersection of the longitudinal axes of the two members of the two pairs of supports 22, 23; 24, 26 to facilitate the handling and reorientation of the log.

As shown in FIGS. 1 and 2, the veneer block is maintained in contact with and rotated on the wheeled log support mechanism 3 by means of a drive roller assembly 4. The roller assembly 4 comprises two drive wheels 66, 67 mounted on hydraulic drive motors 68, 69. These wheels may advantageously comprise conventional pneumatic motor vehicle tires mounted on suitable rims, since such tires provide the necessary compliance and traction for rotating the veneer block. The motors 68, 69 in turn are mounted, respectively, to the lower ends of the support arms 71, 72. These arms 71, 72 are pivotably connected to the frame 7 adjacent their upper ends. Hydraulic cylinders 73, 74 are connected between the support arms 71, 72 and the frame 7 for moving the wheels 66, 67 into and out of contact with the veneer block as shown in FIGS. 10–12. These hydraulic cylinders are controlled by a solenoid valve, not shown, which is enabled to extend the support arms 71, 72 and thereby move the drive wheels 66, 67 into contact with the veneer block when the solenoid valve which actuates the log support mechanism 3 is disenabled by the control switches 61, 62, 63, 64.

Figure 6:
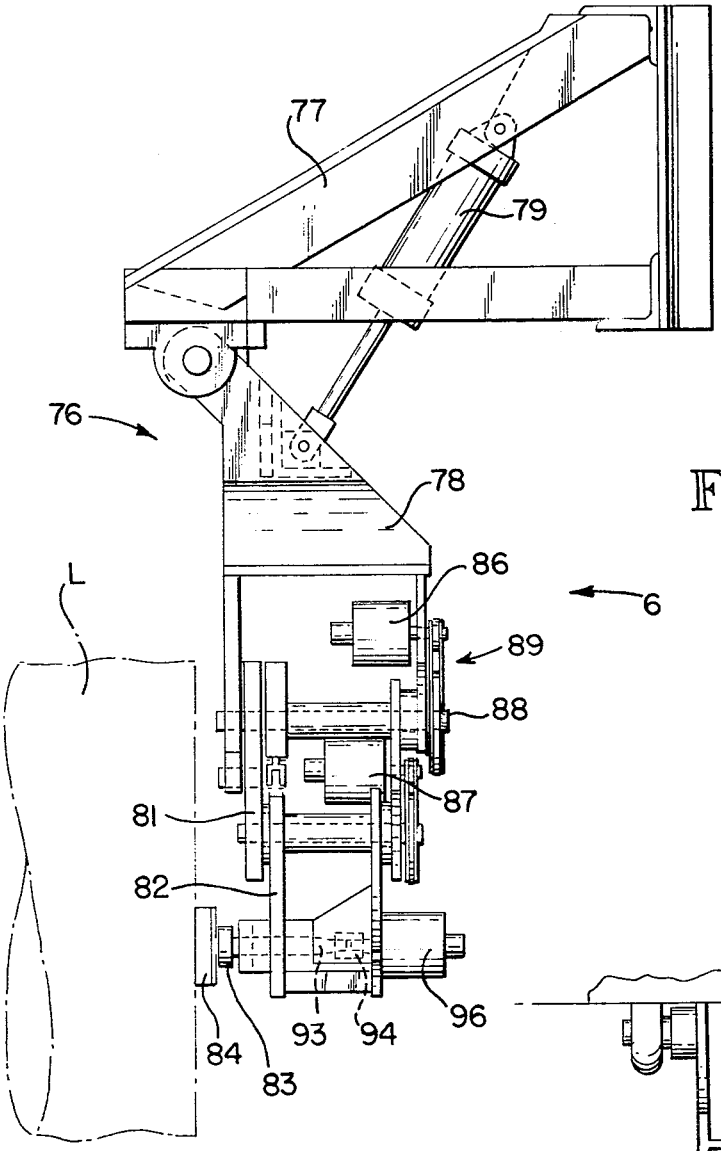
FIG. 6 is a cross-sectional detail taken along line 6—6 of FIG. 2 of one of the log positioning and charging mechanisms of the apparatus of FIG. 1.
Figure 7:
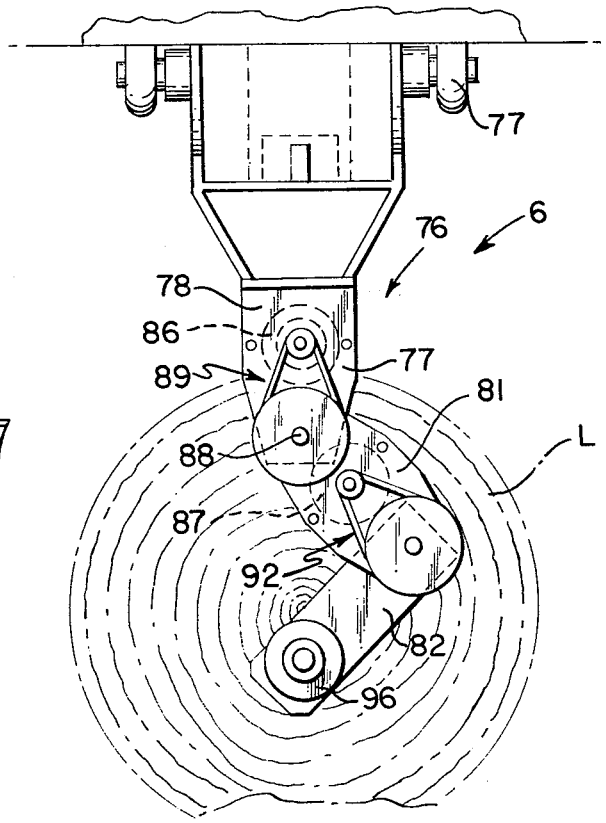
FIG. 7 is an end view of the mechanism of FIG. 6.

The tracking arm assembly 6 comprises two substantially identical tracking arms 76, one arm being provided for tracking the movement of each end of the veneer block. As shown in FIG. 6, the tracking arm comprises a mounting bracket 77 for mounting the arm to the frame 7. An arm support 78 is pivotally connected to the mounting bracket 77 and is movable by means of an hydraulic cylinder 79 from an extended position adjacent the anticipated location of one end of the veneer block positioned in the support mechanism 3, to a retracted position remote from the end of the veneer block. A first arm member 81 is connected at its end to the lower end of the arm support 78 for pivotal movement in a plane perpendicular to that of the arm support 78. A second arm member 82 is in turn connected to the free end of the first arm member 81 for pivotal movement in the same plane as the first arm member 81.

A veneer block engaging shoe 83 is, in turn, pivotably connected to the free end of the second arm member 82. The veneer block engaging face 84 of the shoe 83 is made of an elastomeric material which has a sufficiently high coefficient of friction with the face of the veneer block to prevent slipping thereof during rotation of the block by the drive roller assembly.

Movement of the tracking arm is monitored by means of two absolute encoders 86, 87 mounted respectively on the arm support 78 and the first arm member 81. The first absolute encoder 86 is connected to the pivot 88 between the arm support 78 and the first arm member by means of a belt and pulley step-up system 89 which drives the encoder 86 at a rate four times greater than the pivot 88, resulting in greater resolution and accuracy.

The second absolute encoder 87 is also connected to the pivot 91 between the first and second arm members 81, 82 by means of a step-up belt and pulley drive 92 in like manner. The shoe 83 on one of the two tracking arms 76 is connected by means of a drive shaft 93 and coupler 9 to a third absolute encoder 96 which permits monitoring of the rotational position of the veneer block. All of the absolute encoders are connected to data processing equipment, such as a general purpose digital computer, in a conventional manner for providing positional data thereto.

The tracking arms 97, 98 may advantageously be biased into a neutral or rest position by means of springs so as to repeatably engage the log ends at fixed positions relative to the frame. The data processor uses the angular position of the two arm members 81, 82 derived from the absolute encoders 88, 87 together with the length thereof to determine the position of the frogs 83 relative to a position which is fixed with respect to the frame 7 mathematically.

The carriage type charger assembly 8 comprises two charger arms 97, 98 which are movable between a first position adjacent the log support mechanism 3 and a second lathe charging position remote from the log support mechanism 3. As these charger arms are identical, only one will be described. The charger arms 97, 98 are slidably mounted to the frame 7 for horizontal movement between the first and second positions. Each charger arm 97, 98 is driven along the frame by means of a single reversible hydraulic drive motor 99 and two substantially identical chain and sprocket drives 102, 103. As best shown in FIGS. 8 and 9, each chain and sprocket drive comprises an endless chain engaged with three idler sprockets 106, 107, 108 and one drive sprocket 109 which drive sprocket 109 is connected to the drive shaft 100. The reversible hydraulic motor 9 is connected to the drive shaft by means of a coupler 111. The charger arms 97, 98 are connected to the respectively associated chain and sprocket drive 102, 103 by means of resilient couplers 112 which preferably each comprise pneumatic cylinder biased to a retracted position by compressed air. This coupling permits the two charger arms 97, 98 to be displaced out of alignment with respect to one another, as hereinafter described.

The charger arm 97 further includes a charger shoe 113 mounted on a telescoping base. The shoe 113 is vertically positionable by a hydraulic linear positioner 115 which is controlled by a stepping motor 116. This device 115 uses a positioning valve connected to the shoe and a screw drive connected to the stepping motor 116. The stepping motor 116 which is connected to and driven by the data processor drives the input shaft of the valve to the desired position whereupon a hydraulic cylinder drives the telescoping base 114 to the position of the valve. When the base 114 and valve feedback shaft are in the same position, the valve is closed. Conversely, if the valve and the base 114 are not in the same position, the hydraulic cylinder is actuated by the valve to raise or lower the base 114. A suitable linear servo valve which may advantageously be used to control the hydraulic cylinder 115 is the Model LS-300 linear device maufactured by Olsen Controls, Inc., of Bristol, Conn.

A shock absorber 117 is also mounted to the charger arm 97 for engagement with a ball screw positionable stop 118 and cushioning the movement of the charger arm 97 into contact with the stop 118 when the charger 8 is moved to its first position. The movement of each charger arm is constrained by a stop 118 which stop comprises a stepping motor 119, connected to a ball screw 121 which combine to move the face of the stop toward and away from the second charger arm position. The stepping motor 119 of each stop 118 is connected to and controlled by the data processor. As each charger arm 97, 98 is connected to the respectively associated chain and sprocket drive by means of the resilient coupler 112, the charger arms 97, 98 can be skewed in a horizontal plane relative to one another by the data processor by moving the stops 118 associated with each charger arm to different positions. Movement of the charger arm 97 is limited to the other extreme by a shock absorbing stop which engages each charger arm 97 and position. Both charger arms 97, 98 are maintained in their extreme positions by means of the hydraulic motor 99 which may be stalled without damage. Thus the position of the shoes 113 of each charger is independently adjustable horizontally by means of the stop 118 and vertically by means of the hydraulic linear positioner 115 associated with the arm.

The shoe 113 is further movable to clamp or release the end of a veneer block by means of a hydraulic cylinder 122, best shown in FIG. 9. The shoe is slidably connected to the telescoping base 114 such that it can only move in a direction normal to the vertical and horizontal paths of movement of the charger arm 97 as described above.

Although this equipment can be operated sequentially by an operator, it is a simple matter and within the skill of one of ordinary skill in the art to program a data processor, such as a programmable controller, to operate the equipment in the proper sequence. Of course, one of ordinary skill would be aware that position sensing elements should be attached to various of the movable members to facilitate control and sequencing of the equipment.

The largest solid of rotation contained within the veneer block is determined as follows. A veneer block entering the system is loaded onto the yokes 9, 11 and raised to a position at which the approximate centers of the ends thereof are positioned adjacent the hydraulic clamping shoes 17, 18 of the infeed charger. The hydraulic clamping shoes 17, 18 are then actuated to grip the veneer block at these center locations, the yokes 9, 11 are lowered, and the hydraulic cylinders 19, 21 are actuated to transfer the block to the veneer block support mechanism 3, as shown in FIG. 10. The clamping shoes 17, 18 are then retracted and the infeed charger 2 is returned to its log receiving position.

Each end of the veneer block is then positioned by the respectively associated pair of wheeled log supports 21, 22; 32, 24 in accordance with the setting of the switches 61, 62, 63, 64 by the cams 58, 59 which are connected to the supports. This results in a geometric centering of the veneer block by the supports since, as a rule, the smaller end will be raised further than or lowered less than the larger end of the block and until at least one of the wheel assemlies 36, 37 of each pair of supports is perpendicular to the longitudinal axis of the associated square shaft 31. Truly cylindrical or conical logs will, of course, be positioned with their central axis extending through the points of intersection of the longitudinal axes of both pairs of supports 22, 23; 24, 26.

When the solenoid valves controlling extension or retraction of the support pairs 22, 23; 24, 26 have been disenabled, the hydraulic cylinders 73, 74 are actuated to lower the drive wheels 66, 67 into engagement with the log, as shown in FIG. 11.

The tracking arms 76 of the tracking arm assembly 6 are then lowered into engagement with the ends of the log. The neutral position of the tracking arms 76 causes the shoe 83 to engage the ends of the veneer block at positions approximately $\frac{5}{8}$ inches below the geometric center axis of the veneer block.

When the tracking arms are in position, the hydraulic motors 68, 69 are then actuated to begin rotation of the log. The three absolute encoders on one tracking arm 76 are periodically referenced by the data processor and are summed to determine the angle of rotation of the veneer block. The angular position of the three absolute encoders on one arm and two absolute encoders on the other are stored in the memory of the data processor at fixed increments of rotation; and data gathering and log rotation is terminated when data for 360° of log rotation has been gathered. Preferably, data will be gathered from the absolute encoders each three to four degrees of rotation of the log, but greater or lesser rotation increments can be used. Since as the length of the arm members 81, 82 are known, the position of any point fixed with respect to the position of the frame 7 or log supports 22, 23; 24, 26 can be determined. In the present embodiment, the length of the arm members 81, 82 of each tracking arm and the five angular measurements are used to determine the distance from the center of the shoe 83 to a reference point three inches below the original geometric axis of the veneer block at each end of the log, which reference point comprises the datum from which the measurements are made. This geometric axis is defined by the points of intersection of the longitudinal axes of the two pairs of supports 22, 23; 24, 26. This distance is then stored in memory in a table as a radius. An angle valve is then calculated and stored in a data processor together with this radius to give a polar coordinate pair which define a point in space. This angle is determined by calculating the value angle between a line extending from the shoe 83 to the reference point and a vertical line, and this angle value is added to the angle of rotation of the log. This process is executed for each increment of rotation of the log and is repeated for the tracking data at the other end of the log to yield two tables of polar or (r, $\theta$) coordinate data. These data tables are then transformed to produce two corresponding Cartesian or (X, Y) coordinate tables which are the loci of points used to determine the center axis of the largest cylinder contained in the log.

Each polar coordinate table is searched to find the minimum radius value contained therein and the corresponding radius and angle values for each of these are used to locate the initial test points for each end of the log. The slope from this first constraining point to the origin is determined and a displacement value is then used with this point and slope to locate the first test point. The displacement value is initially chosen as one-half of the distance from the geometric axis to the reference point, or, in the present case, 1 and $\frac{1}{2}$ inches.

The test point is then chosen as the point on the line extending from the first constraining point through the origin which is distant from the first constraining point by an amount equal to the displacement value. This is accomplished by determining the Cartesian X and Y displacements for moving a distance equal to the displacement value at the determined slope.

After the first test point has been found, the Cartesian coordinate data for all the points in the locus are tested and the point closest to the test point is determined.

The distance to this point from the test point is stored in memory, and the displacement value is divided by two and stored.

A trial point is then chosen which is distant from the test point by the new displacement value in a direction away from the new constraining point. If the distance from the trial point to the nearest point of the locus is greater than the radius test value, the trial point becomes the new test point. If not, points distant from the test point by the displacement value along a line perpendicular to the line through the trial point are examined as prospective test points.

If none of the trial points yields a greater radius test value, the old test point is retained. Otherwise, the trial point which yields the largest radius test value is chosen as the new test point. This processing is repeated until the displacement value has been reduced by division to a point where it is less than the positioning accuracy of the hydraulic linear positioner 115 or the stop 118 and is therefore insignificant. For example, if the initial displacement value is 1.5 and the positioning resolution of the charger 8 is 0.01 inches, the displacement value would be insignificant after it had been divided by two in eight repetitions of the process. The process is then repeated for the coordinate data which defines the locus of points for the other end of the veneer block.

The last test points chosen are the point on the ends of the veneer block through which the axis of the largest cylinder or conic section passes. The location of these points are then used in conjunction with the position of the frog 86 on each tracking arm 76 to determine the position to which the shoe 113 of each charger arm 97, 98 should be raised and the position to which each ball screw stop 118 should be set. The data processor then actuates the stepping motors 119, 120 on the stops 118 and the hydraulic linear positioner 115. The hydraulic motor is then activated to move the charger arms 97, 98 into contact with the ball screw stops 118 as shown in FIG. 12 and the hydraulic cylinders 122 are activated to extend the charger shoes 113 to grip the veneer block about the points on the ends thereof through which the desired axis extends. The log support mechanism 3 and drive roller assembly 4 are then retracted and the hydraulic motor 99 is reversed to move the charger arms against the other stops 123, in which position the veneer block can be chucked in the spindles of a veneer lathe or round-up lathe. As the charger arms 97, 98 are moved to this position, the computer actuates the stepping motors 120 to adjust the height of the charger shoes 113 such that, when the charger arms 97, 98 are engaged with the stops 123, the veneer block is positioned in the lathe for chucking by the lathe spindles at the two points on the ends of the block which define the axis of the largest cylinder.

Figure 13:
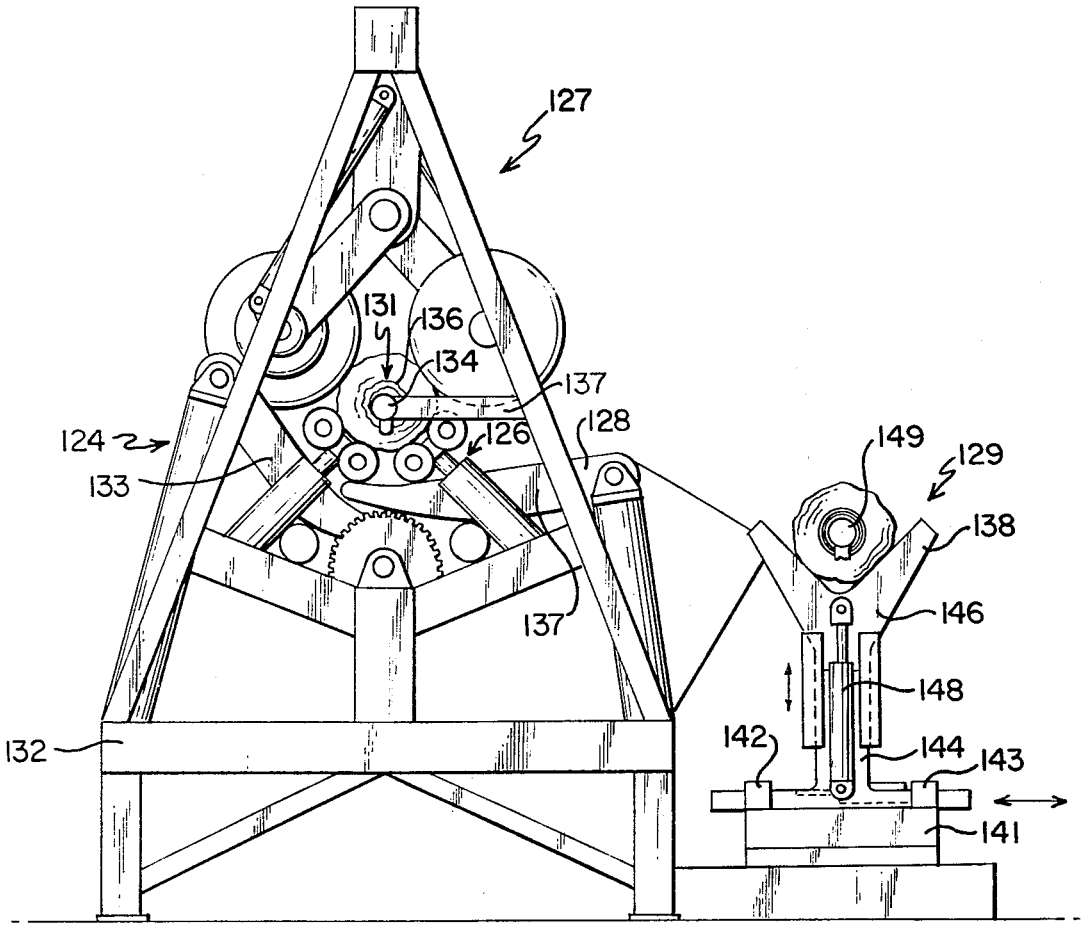
Figure 14:
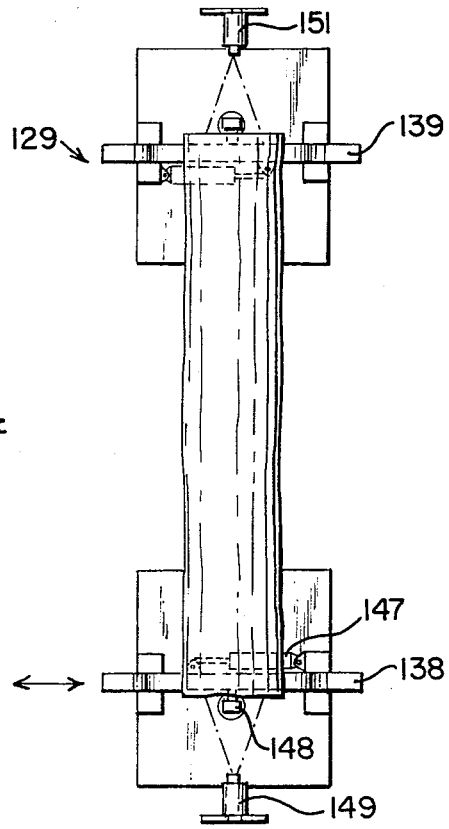

FIGS. 13 and 14 show a second embodiment of the invention in which the movement of the ends of the log during rotation is monitored by means of a marking device rather than by tracking arms 97, 98. In this embodiment, a conventional loader 124 is used to load the veneer logs into the log support mechanism 126. It will be appreciated, however, that any suitable infeed mechanism such as that shown in FIGS. 1 and 2 may be used to load the veneer block support mechanism 126. The apparatus further comprises a drive roller assembly similar to that described with respect to FIG. 1, and a hydraulically operated unloader for transferring veneer blocks from the support mechanism 126 to the positioning yoke assembly 129. The apparatus further comprises an airless spray system 131 which is mounted to the frame 132.

The loader 124 comprises a pair of hydraulically extensible loader arm 133 pivotably connected to the frame 132. The loader arms may be raised and lowered to place a veneer block in the support mechanism 126. The support mechanism 126 and drive roller assembly 127 as functionally and structurally identical to that described with respect to the centering apparatus of FIGS. 1 and 2 and serve to rotate the log. As with the mechanism of FIG. 1 the supports which comprise the support mechanism are extensible and retractable but, during rotation of the veneer block, are maintained in a fixed position relative to the frame.

An airless spray system 131 is used to monitor or track the motion of the ends of the veneer block during rotation. This sprayer system 131 comprises two conventional airless spray heads (only one shown) located in positions adjacent the two ends of the veneer block for spraying a trace 136 of paint or dye onto the ends of the veneer block as it is rotated. The trace 136 on each end of the veneer block serves as the locus of points for use in determining the center axis of the largest solid of rotation, such as a cylinder or cone frustum, which is contained in the veneer block. The two identical spray heads 134 are the datums to which movement of the respective ends of the log are related to obtain the loci of points, i.e. the traces 136. These spray heads 134 are mounted on cantilevered beams 137 such that the traces 136 will be marked on the ends of the block at a position directly beneath the geometric centering axis thereof. This geometric centering axis, of course, is the line which passes through the two points defined by the intersections of the longitudinal axes of the two support pairs.

Although the point of impact of the paint or dye on the ends of the log must be below the geometric axis, the distance beneath this axis at which it impacts is not critical. The points of impact, of course, should not be chosen too far below the geometric axis or the spray may miss the end of the log entirely resulting in an incomplete trace 136. In order to prevent excessive paint buildup, the spray heads are activated only when the veneer block is supported on the support mechanism 126 and the drive roller assembly is causing rotation of the log. Preferably, the spray will only be activated for a single rotation of the log, although the log may be sprayed during multiple rotations thereof. The unloader 128, like the loader 133, is of conventional design and comprises a pair of hydraulically extensible arms 137 which are pivotably mounted to the frame 132 and which may be raised to lift the log or veneer block from the support mechanism 126. When the unloader arms 137 to a sufficient extent, the veneer block rolls into the positioning yoke assembly 129 where the center axis of the largest cylinder is determined. It should be noted, however, that the traces may be permanently marked on the ends of the veneer block, and accordingly, the veneer blocks could be marked with the traces remotely from the positioning yoke, stored, and later loaded into the positioning yokes by conventional means, such as a conveyor, for centering and loading into the veneer lathe.

As shown in FIGS. 13 and 14, the positioning yoke assembly comprises two positionable yokes 138, 139 which are independently movable vertically and horizontally to reposition the log. As the two yokes are substantially identical, only one yoke will be described.

The yoke 138 comprises a base 141 to which is mounted a pair of bearing blocks 142, 143. These blocks include apertures which receive the base of the vertical support 144 and constrain it to horizontal movement only as shown by the arrows.

The upper portion 146 of the yoke 138 is slideably mounted to the vertical support 144 for vertical movement only with respect thereto. Hydraulic cylinders 147, 148 control the horizontal and vertical positioning respectively, of the yoke and may be actuated by the operator to alter the position of the veneer block. It should be noted that the yokes 138, 139 are located to receive the veneer block as close to the ends thereof as practical so that horizontal and vertical displacement of one end will not substantially effect the positioning of the other end of the block.

Two conventional projectors 149, 151 are mounted adjacent the yokes for projecting circular light ring patterns on each end of the log. These projectors, which are of conventional slide projector design, are aligned with a veneer lathe or other veneer block or log processing equipment such that the centers of the light rings patterns projected on each end of the log is aligned with a log transfer mechanism which can clamp the log about these points and transfer it to the veneer lathe for clamping at these points. Such transfer equipment is well known in the art and may comprise a conventional pendulum lathe charger.

In operation, a log entering the system is rolled along the loader arms 133 of the loader 124 and positioned in the support mechanism 126. The drive roller assembly 127 is then lowered to engage the surface of the log and commence rotation thereof. When the veneer block has commenced rotation, the sprayers 134 of the airless spray system 131 are actuated to paint traces 136 on each end of the veneer block. Spraying and rotation of the veneer block may be terminated after a single revolution. The drive roller assembly 127 is then retracted and the unloader 128 is actuated to roll the veneer block along the arms 137 and into the positioning yokes 138, 139. The operator then adjusts the position of each end of the log until the largest possible light ring which can be fit is projected within the boundaries of the trace. If desired, a mirror or mirrors may be positioned adjacent the ends of the log so that a single operator can see both traces from a single position and perform the orientation of the block from that position. The centers of the light rings, as projected on the ends of the log, define the axis of the largest cylinder or other solid of rotation which can be fit within the log. Consequently, when the fitting of the largest light ring has been completed at each end of the veneer block, the log is positioned with its center axis aligned according to the projected light rings. It will be appreciated that this method also defines a point central to the points in the trace or locus in the sense that the largest circle which can be projected within the trace has but a single center point.

This methiod of locating the center axis of the log is equivalent to that performed by the tracking arm assembly and data processor in that both methods seek to maximize the distance of the trial point from the nearest member of the locus of points. In the first embodiment, however, the points on each face of the log which define the center axis are determined and a charger is repositioned to grip the log about these points by contrast, in the second embodiment, the two points which define the axis are projected by the projectors 149, 151 and the log is adjusted to move the loci of points (the traces 146) until the projected points are coincident with the desired axis of the log.

Both methods have the distinct advantage over prior art methods in that the monitoring of the motion of the veneer block is accomplished at its end. Other prior art systems sense the log at various positions spaced along its length irrespective of the exact position of the ends thereof. Accordingly, respositioning of the veneer block is accomplished in accordance with points on the ends of the log which need not be extrapolated from data gathered at locations remote from the block ends.

The present equipment has the further advantage of not using optical scanning equipment which may become blocked by bark chips, steam from the prepared veneer block, or other factors inherent in the mill environment. Moreover, the apparatus is mechanically simple so as to reduce the amount of time when the equipment is out of service due to maintenance requirements.

The present invention has been described with respect to a veneer plant, however, it is well known in the wood processing industry that it is advantageous to align the center axis of the largest cylinder with for example, the saw line of a saw mill in order to maximize the recovery of wood products. Moreover, where large pieces such as railroad ties are being sawn from small logs, the sawing of the log about the axis of the largest cylinder which may be fit therein will minimize the amount of wane on the edges of the tie and will tend to equalize such wane among the four edges so as to produce as uniform and high quality a product as possible.

Although the present illustrated embodiments have been described with respect to procedures for determining the center axis of the largest inscribed cylinder or other solid of resolution, it will be appreciated that other larger or smaller surfaces inscribed or otherwise, may be located utilizing the generated loci in various manners. For example, it might be desired to define the center of the smallest exscribed circle at each end of the body which bounds all the points forming the locus.

What is claimed is:

1. An apparatus for locating the center axis of the largest solid of rotation obtainable from an irregular elongated body according to predetermined processing standards comprising;

rotational support means for rotating said body in such a manner as to allow displacement of the opposite ends thereof during rotation so as to reflect the non-cylindrical characteristics of the body, means for generating a locus of points for each end face of the body representative of the motion thereof relative to a datum, means for defining for each locus a point generally central to the points comprising the locus, which point bears a predetermined relationship with the points comprising the locus, said centrally located points defining said center axis.

2. The apparatus of claim 1 wherein said rotational support means includes means for supporting said body at least at two support locations spaced inwardly from the ends thereof.

3. The apparatus of claim 2 wherein said means for generating a locus of points comprises two tracking arms for releasably engaging the ends of the body and sensing movement thereof as the body is rotated.

4. The apparatus of claim 2 wherein said rotational support means includes pairs of extensible supports for rotatably supporting said body.

5. The apparatus of claim 4 wherein the longitudinal axis of the members of said pairs of supports diverge from one another at a predetermined angle.

6. The apparatus of claim 5 wherein each of said pairs of supports includes means for extending the members of said pair along their axes in unison.

7. The apparatus of claim 4 wherein each member of said pairs of supports includes wheeled body engaging means pivotably connected to said member for supporting said body at two points about its periphery on opposite sides of said pivotal connection.

8. The apparatus of claim 2 wherein said rotational support means is adapted to support said body at locations spaced inward from the ends of the body by a distance of between 13% and 21% of the length thereof.

9. The apparatus of claim 8 wherein the rotational support means is adapted to support said body at locations spaced inward from the ends of the body by approximately one-sixth of the length thereof.

10. The apparatus of claim 2 wherein said means for generating a locus of points comprises marking means positioned adjacent at least one of the body for marking the end of the body as it is rotated.

11. The apparatus of claim 10 wherein said marking means is positioned below the axis of rotation of the body.

12. The apparatus of claim 2 wherein said means for generating a locus of points comprises means for monitoring motion of one point on each end of the log relative to a datum point.

13. The apparatus of claim 11 wherein said monitoring means includes:

arm means connected to said rotational support means and engageable with at least one end of the log;

means for generating an output signal in response to movement of said arm as the position thereof changes in response to rotation of the log, means for interpreting said signal to generate a locus of points.

14. The apparatus of claim 13 wherein said signal interpreting means includes:

means for determining the position of the body-engaging portion of the arm means relative to a datum; and means for storing said position.

15. The apparatus of claim 14 wherein said signal generating means includes a positional encoder connected to said arm means and wherein said signal interpreting means includes a programmable computer.

16. The apparatus of claim 2 wherein said generally centrally located points define a reference axis, further comprising:

first and second engaging means for releasably engaging the body adjacent respective opposite ends thereof, drive means for moving said first and second engaging means from a first position wherein said means are aligned with a datum line to a second position wherein said engaging means are aligned with said reference axis, positioning means located adjacent said predetermined location for limiting travel of at least one of said first and second engaging means toward said second position, resilient coupling means for connecting each said engaging means to said drive means whereby one engaging means may be resiliently offset from its position relative to the other engaging means upon contact with the positioning means.

17. The apparatus of claim 16 further including means for adjusting the position of said first and second engaging means in a direction perpendicular to the path of travel of said engaging means from said first position to said second position.

18. The apparatus of claim 16 wherein said positioning means includes adjustable stop means positioned to engage said first and second engaging means, respectively, and to limit the travel thereof.

19. The apparatus of claim 18 further comprising second stop means for limiting travel of said first and second engaging means in a direction toward said first position, whereby the position of said first and second engaging means in said first position is controlled.

20. The apparatus of claim 5 wherein said predetermined angle is approximately equal to 90°.

21. A method for locating the center axis of the largest solid of rotation obtainable from an irregular elongated body according to predetermined processing standards comprising;

rotating said body in such a manner as to allow displacement of the opposite ends thereof during rotation so as to reflect the non-cylindrical characteristics of the body, generating a locus of points for each end face of the body representative of the motion thereof relative to a datum, and defining a point for each locus generally central to the points comprising the locus, which point bears a predetermined relationsip with the points comprising the locus, said centrally located points defining said center axis.

22. The method of claim 20 wherein said body is rotatably supported at least at two locations spaced inwardly from the ends thereof during the step of rotating the body.

23. The method of claim 22 wherein the step of generating a locus of points includes the step of mechanically engaging the body with tracking members and monitoring the position of the sensors at a plurality of rotational positions of the body.

24. The method of claim 23 wherein the body is supported at two pairs of support points located, respectively, at the two support locations, the members of each such pair being positioned on opposite sides of the longitudinal axis of the body.

25. The method of claim 24 wherein the support locations are spaced inward of the ends of the body by a distance of between 13% and 21% of the length of the body.

26. The method of claim 21 wherein the step of generating a locus of points includes the further steps of positioning a marking device adjacent each end of the body, marking a trace on each end of the body representative of motion of the body past the marking device.

27. The method of claim 22 wherein the step of generating a locus of points includes the further step of monitoring the position of one point on each end of the log relative to a datum point.

28. The method of claim 22 further including the step of reorienting the position of the body, as defined by the centrally located points, relative to a datum line.

29. Apparatus for supporting and positioning an irregular elongated body at a predetermined location, comprising;

first support means for contacting said body at a first location on the surface thereof, extensible support means positioned adjacent the surface of said body at a second location for supporting the body and moving the same to said predetermined location, contact means pivotably connected to said extensible support means for contacting the body at two points on opposite sides of the pivotable connection thereof and transferring loads thereto, means for extending said support means, and means for terminating extension of said support means when a line through said points is at a predetermined angle relative to a preselected datum line, whereby said predetermined angle may be chosen to position said body at said predetermined location.

30. The apparatus of claim 29 wherein extension of said support means moves said means closer to said first support means.

31. The apparatus of claim 29 wherein said first support means is extensible and wherein said first and second support means comprises two pairs of extensible support members, the members of each pair being positioned on opposite sides of a vertical plane through the longitudinal axis of said body.

32. The apparatus of claim 31 wherein each said pair of support members adjacent is positioned to support the body adjacent one end thereof and wherein the mbmers of each such pair are extensible in unison independently of the members of the other pair.

33. Apparatus for reorienting an elongated body relative to a datum line, comprising:

means for retaining said body in a predetermined location;

means for defining a reference axis having a predetermined relation to said body when said body is located in said predetermined position;

first and second engaging means for releasably engaging said body adjacent respective opposite ends thereof;

drive means for moving said first and second engaging means from a first position wherein said means are aligned with said datum line to a second position wherein said engaging means are aligned with said reference axis;

positioning means located adjacent said predetermined location for limiting travel of at least one of said first and second engaging means toward said second position;

resilient coupling means for connecting each said engaging means to said drive means whereby one engaging means may be resiliently offset from its position relative to the other engaging means upon contact with the positioning means, whereby the position of said first and second engaging means in said second position is controlled.

34. The apparatus of claim 33 wherein said positioning means includes two positionable stops for restricting movement of said first and second engaging means toward said second position.

35. The apparatus of claim 34 further including means for adjusting the position of the first and second engaging means in a direction generally perpendicular to the movement thereof from said first position to said second position.

* * * * *